US008100712B2

(12) United States Patent
Sun

(10) Patent No.: US 8,100,712 B2
(45) Date of Patent: Jan. 24, 2012

(54) RJ-45 CONNECTOR

(75) Inventor: Zheng-Heng Sun, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 82 days.

(21) Appl. No.: 12/825,309

(22) Filed: Jun. 28, 2010

(65) Prior Publication Data

US 2011/0256757 A1 Oct. 20, 2011

(30) Foreign Application Priority Data

Apr. 15, 2010 (CN) ..... 2010 1 0147623

(51) Int. Cl.
*H01R 3/00* (2006.01)

(52) U.S. Cl. ..... 439/490

(58) Field of Classification Search ..... 439/490
See application file for complete search history.

(56) References Cited

U.S. PATENT DOCUMENTS

| | | | | |
|---|---|---|---|---|
| 4,925,402 | A * | 5/1990 | Inaba et al. | 439/490 |
| 6,241,550 | B1 * | 6/2001 | Laity et al. | 439/490 |
| 7,194,183 | B2 * | 3/2007 | Thornton et al. | 385/139 |
| 2006/0286856 | A1 * | 12/2006 | Sakamoto | 439/490 |

* cited by examiner

*Primary Examiner* — Truc Nguyen
(74) *Attorney, Agent, or Firm* — Altis Law Group, Inc.

(57) ABSTRACT

A Registered Jack-45 (RJ-45) connector matching a connector with two light emitting diodes includes a main body forming two light guide posts. Each light guide post includes a first end facing a corresponding light emitting diode, and a second end opposite to the first end. The light guide posts transmit light emitted by the light emitting diodes from the first ends to the second ends of the light guide posts.

16 Claims, 3 Drawing Sheets

RJ-45 CONNECTOR

This relevant subject matter is disclosed in a co-pending U.S. patent application entitled "RJ-45 connector", filed on Jun. 29, 2010, with application Ser. No. 12/825,339, which is assigned to the same assignee as this patent application.

BACKGROUND

1. Technical Field

The present disclosure relates to a Registered Jack-45 (RJ-45) connector.

2. Description of Related Art

RJ-45 connectors are widely used in network communication. In use, an RJ-45 connector is engaged in an interface of a chassis of a computer or a server. The interface includes two light emitting diodes, used to indicate whether the network connection is working properly. However, in most cases, the interface is defined in a rear end of the chassis, thus light generated by the light emitting diodes is only seen from the back of the chassis, which is inconvenient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings in which like references indicate similar elements, is illustrated by way of examples and not by way of limitation. It should be noted that references to "an" or "one" embodiment in this disclosure are not necessarily to the same embodiment, and such references mean at least one.

Figure 1:
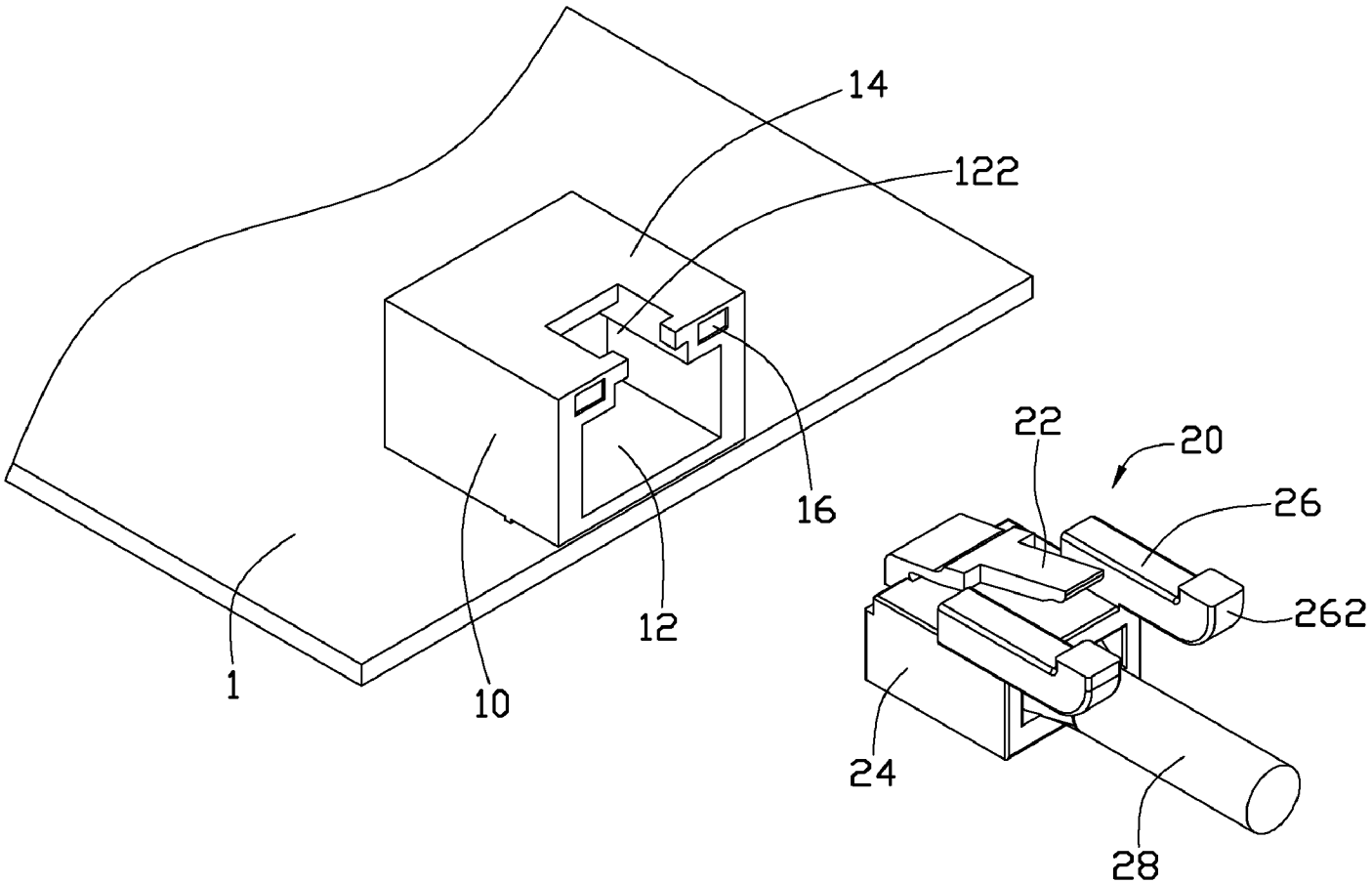
FIG. 1 is an exploded, isometric view of one embodiment of a Registered Jack-45 (RJ-45) connector and a motherboard.
Figure 2:
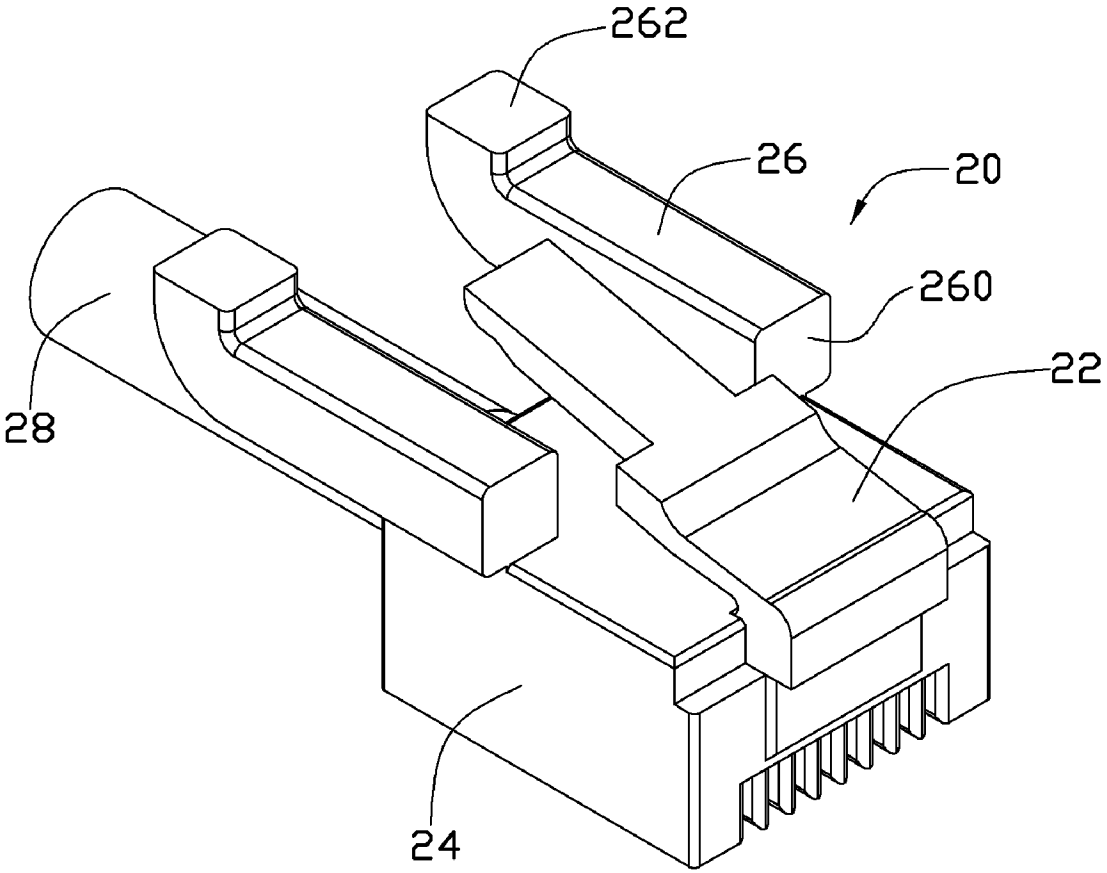
FIG. 2 is an enlarged view of the RJ-45 connector of FIG. 1, but viewed from another perspective.

Referring to FIGS. 1, and 2, one embodiment of a Registered Jack-45 (RJ-45) connector 20 includes a main body 24, and a cable 28 extending from a first end of the main body 24.

An elastic latch 22 is formed on a second end of the main body 24 opposite to the first end and extends slantingly above a top surface of the main body 24. Two light guide posts 26 are formed on the top surface of the main body 24. The two light guide posts 26 are substantially parallel to and spaced apart from each other. The elastic latch 22 is positioned between the two light guide posts 26. Each light guide post 26 includes a first end 260 and a second end opposite to the first end 260. The second end of each light guide post 26 extends out of the top surface of the main body 24, and a distal end of the second end extends upward to form a protrusion 262. Each first end 260 of the light guide posts 26 is positioned on a side of a center of the top surface of the main body 24. The light guide posts 26 can be made of transparent plastic material.

The RJ-45 connector 20 can be inserted into a connector 10 of a motherboard 1. The connector 10 includes a housing 14. The housing 14 defines a receiving space 12. Two light emitting diodes 16 are mounted to the housing 14 above the receiving space 12. An opening 122 is defined in a top of the housing 14, communicating with the receiving space 12. The two light emitting diodes 24 are positioned at opposite sides of the opening 122.

Figure 3:
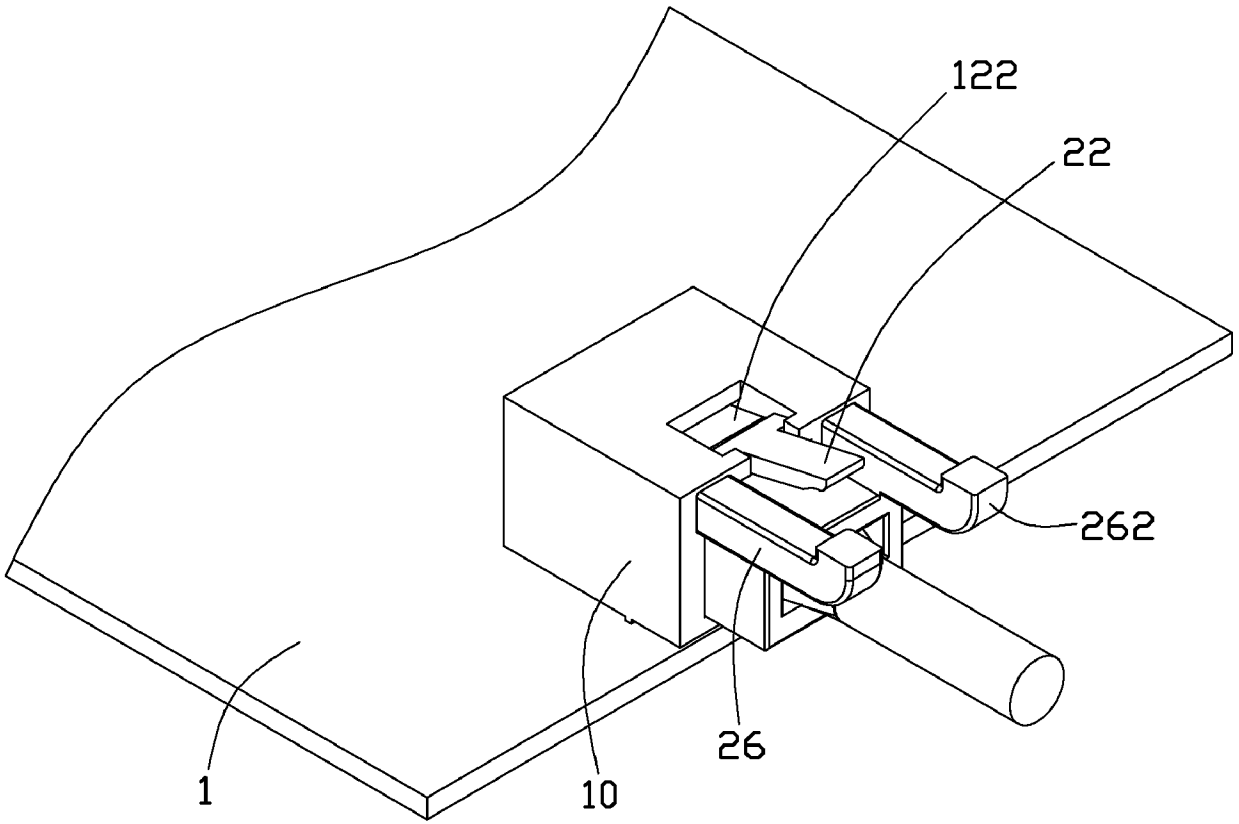
FIG. 3 is an assembled view of FIG. 1.

Referring to FIG. 3, in assembly, the RJ-45 connector 20 is inserted into the receiving space 12 of the connector 10. The elastic latch 22 is engaged in the opening 122. The first end 260 of each light guide post 26 aligns with and faces a corresponding light emitting diode 16. In one embodiment, the first end 260 of each light guide post 26 resists against the corresponding light emitting diode 16. Light generated by the two light emitting diodes 16 is transmitted to the two protrusions 262 which extend outside an enclosure enclosing the motherboard 1. The light can be seen easily.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A Registered Jack-45 (RJ-45) connector matching a connector with two light emitting diodes, the RJ-45 connector comprising:

a main body engaged with the connector, and comprising two light guide posts extending from the main body, each light guide post comprising a first end aligning with and facing a corresponding light emitting diode, and a second end opposite to the first end, wherein the light guide posts transmit light emitted by the light emitting diodes from the first ends to the second ends of the light guide posts; and the main body further comprises an elastic latch extending from the main body opposite to the second ends of the light guide posts, to latch with the connector.

2. The RJ-45 connector of claim 1, further comprising a cable extending from the main body opposite to the connector.

3. The RJ-45 connector of claim 1, wherein the two light guide posts are positioned on a top surface of the main body, substantially parallel to and spaced apart from each other, and the elastic latch is positioned between the two light guide posts.

4. The RJ-45 connector of claim 1, wherein the light guide posts are made of transparent plastic material.

5. The RJ-45 connector of claim 1, wherein the first end of each light guide post resists against the corresponding light emitting diode.

6. The RJ-45 connector of claim 3, wherein the first end of each light guide post is positioned on a side of a center of the top surface of the main body.

7. The RJ-45 connector of claim 3, wherein the second end of each light guide post extends out of the top surface of the main body.

8. The RJ-45 connector of claim 7, wherein each light guide post further comprises a protrusion extending up from the second end of each light guide post.

9. A Registered Jack-45 (RJ-45) connector assembly comprising:

a first connector defining a receiving space and comprising a light emitting diode at a side of the receiving space; and a second connector comprising a main body comprising a first end engaged in the receiving space, a second end opposite to the first end exposed from the first connector, and a light guide post extending from the second end of the main body, the light guide post comprising a first end facing the light emitting diode, and a second end opposite to the first end, wherein the light guide post transmits light emitted from the light emitting diode to the second end of the light guide post.

10. The RJ-45 connector assembly of claim 9, wherein the first connector defines an opening communicating with the receiving space, and the main body further comprises an elastic latch extending from the first end of the main body to engage in the opening.

11. The RJ-45 connector assembly of claim 9, wherein the light guide post is positioned on a top surface of the main body.

12. The RJ-45 connector assembly of claim 11, wherein the first end of the light guide post is positioned on a center of the top surface of the main body.

13. The RJ-45 connector assembly of claim 11, wherein the second end of the light guide post extends out of the top surface of the main body.

14. The RJ-45 connector assembly of claim 9, wherein the light guide post further comprises a protrusion extending up from the second end of the light guide post.

15. The RJ-45 connector assembly of claim 9, wherein the light guide post is made of transparent plastic material.

16. The RJ-45 connector assembly of claim 9, wherein the first end of the light guide post resists against a corresponding light emitting diode.

* * * * *